US009862117B2

(12) United States Patent
Sands

(10) Patent No.: US 9,862,117 B2
(45) Date of Patent: Jan. 9, 2018

(54) BAMBOO SPLITTER

(71) Applicant: David E Sands, Pahoa, HI (US)

(72) Inventor: David E Sands, Pahoa, HI (US)

(73) Assignee: Bamboo Technologies LLC, Pahoa, HI (US)

( * ) Notice: Subject to any disclaimer, the term of this patent is extended or adjusted under 35 U.S.C. 154(b) by 292 days.

(21) Appl. No.: 14/944,878

(22) Filed: Nov. 18, 2015

(65) Prior Publication Data

US 2016/0136840 A1 May 19, 2016

Related U.S. Application Data

(60) Provisional application No. 62/081,111, filed on Nov. 18, 2014.

(51) Int. Cl.
*B27J 1/00* (2006.01)
*B27L 7/00* (2006.01)

(52) U.S. Cl.
CPC . *B27J 1/00* (2013.01); *B27L 7/00* (2013.01); *B27L 7/005* (2013.01)

(58) Field of Classification Search
CPC ..... B27J 7/00; B27J 3/00; B27J 1/00; B27L 7/00; B27L 7/005; B27L 7/06; B27L 7/08; B26D 3/26
See application file for complete search history.

(56) References Cited

U.S. PATENT DOCUMENTS

| | | | | |
|---|---|---|---|---|
| 4,353,401 | A * | 10/1982 | Schilling | B27L 7/00 144/193.2 |
| 6,991,010 | B1 * | 1/2006 | Smith | B27L 7/06 144/193.2 |
| 9,061,436 | B2 * | 6/2015 | Fisher | B27L 7/06 |
| 2012/0067460 | A1 * | 3/2012 | Valdez | B27L 7/06 144/195.8 |

OTHER PUBLICATIONS

Prashant Bamboo Machines, Bamboo Auto Splitter machine, Nov. 6, 2012, https://www.youtube.com/watch?v=TOyllmp1WhM, time stamp 0:16.*

* cited by examiner

*Primary Examiner* — Matthew G Katcoff
(74) *Attorney, Agent, or Firm* — Mark David Torche; Patwrite Law

(57) ABSTRACT

A bamboo splitter has an outer support ring with an interior mounted inner ring blade. A plurality of base blades are radially arranged around the inner ring blade and both the inner ring blade and the base blades have v-shaped cutting surfaces. Attached to each base blade is a pair of slat blades that attach to the base blades at a vertex and have a left and right slat blade. The angle between the vertex and the left and right blades is chosen so that adjacent left slat blades are parallel to adjacent right slat blade forming a parallel cutting space which produces bamboo slats that have orthogonal edges which makes them much more amenable to traditional building methods. A different number of slat blades may be used depending on the size of the bamboo being used and the size and number of the slats being produced.

3 Claims, 12 Drawing Sheets

BAMBOO SPLITTER

CROSS REFERENCE TO RELATED APPLICATIONS

This application claims priority and herein incorporates by reference U.S. provisional patent application 62/081,111, filed Nov. 18, 2014.

BACKGROUND OF THE INVENTION

In recent years more people are becoming aware of the environmental and financial benefits of using renewable building materials as a way of preserving and managing cost and sustaining modern lifestyles. Although not used extensively in the United States, bamboo has many advantages over traditional lumber including ease and speed of growth and strength. As a member of the grass family, it grows relatively fast, especially when compared to the more traditional timber used in the United States. Bamboo has been used for a very long time in Asian countries and is slowly making its way into the Western markets.

Bamboo, unlike traditional timber is mostly hollow and therefore harvesting techniques long used to maximize the yield from forest trees used by the lumber industry does not work very well with bamboo. In many Asian countries, because of their long history of building with bamboo, the bamboo is used without the need to change its basic structure other than simple splitting. Western building techniques rely on techniques that have been developed using lumber and this is a bar to using bamboo to its fullest extent. There is a need to fully utilize bamboo while making it suitable as a building material amenable to Western building techniques.

SUMMARY OF THE INVENTION

A bamboo splitter has an outer support ring with an interior mounted inner ring blade. A plurality of base blades are radially arranged around the inner ring blade and both the inner ring blade and the base blades have v-shaped cutting surfaces. Attached to each base blade is a pair of slat blades that attach to the base blades at a vertex and have a left and right slat blade. The angle between the vertex and the left and right blades is chosen so that adjacent left slat blades are parallel to adjacent right slat blade forming a parallel cutting space which produces bamboo slats that have orthogonal edges which makes them much more amenable to traditional building methods. A different number of slat blades may be used depending on the size of the bamboo being used and the size and number of the slats being produced.

Other features and advantages of the instant invention will become apparent from the following description of the invention which refers to the accompanying drawings.

DETAILED DESCRIPTION OF THE INVENTION

Figure 1:
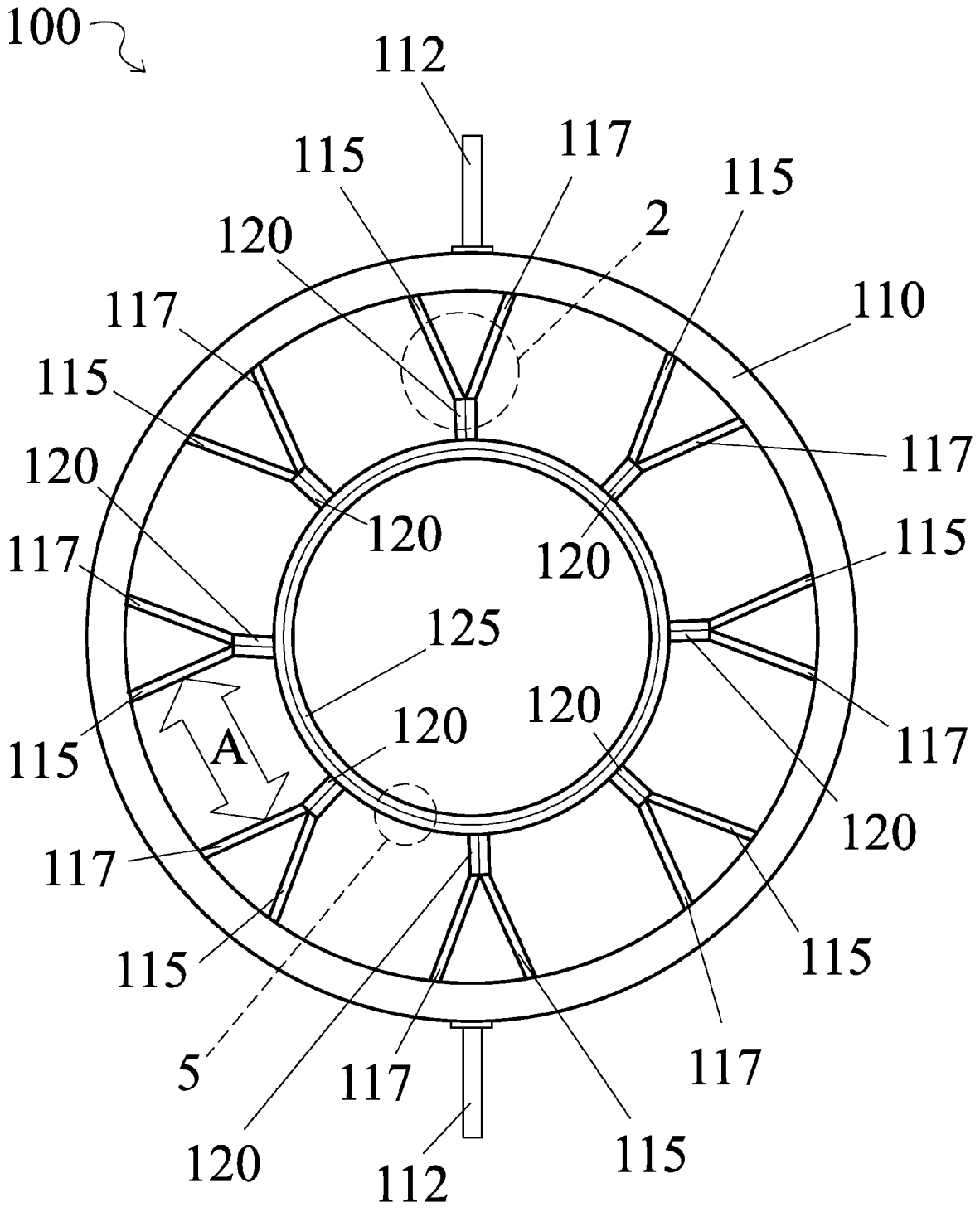
FIG. 1 is a front view of a bamboo splitter according to an embodiment of the invention.
Figure 2:
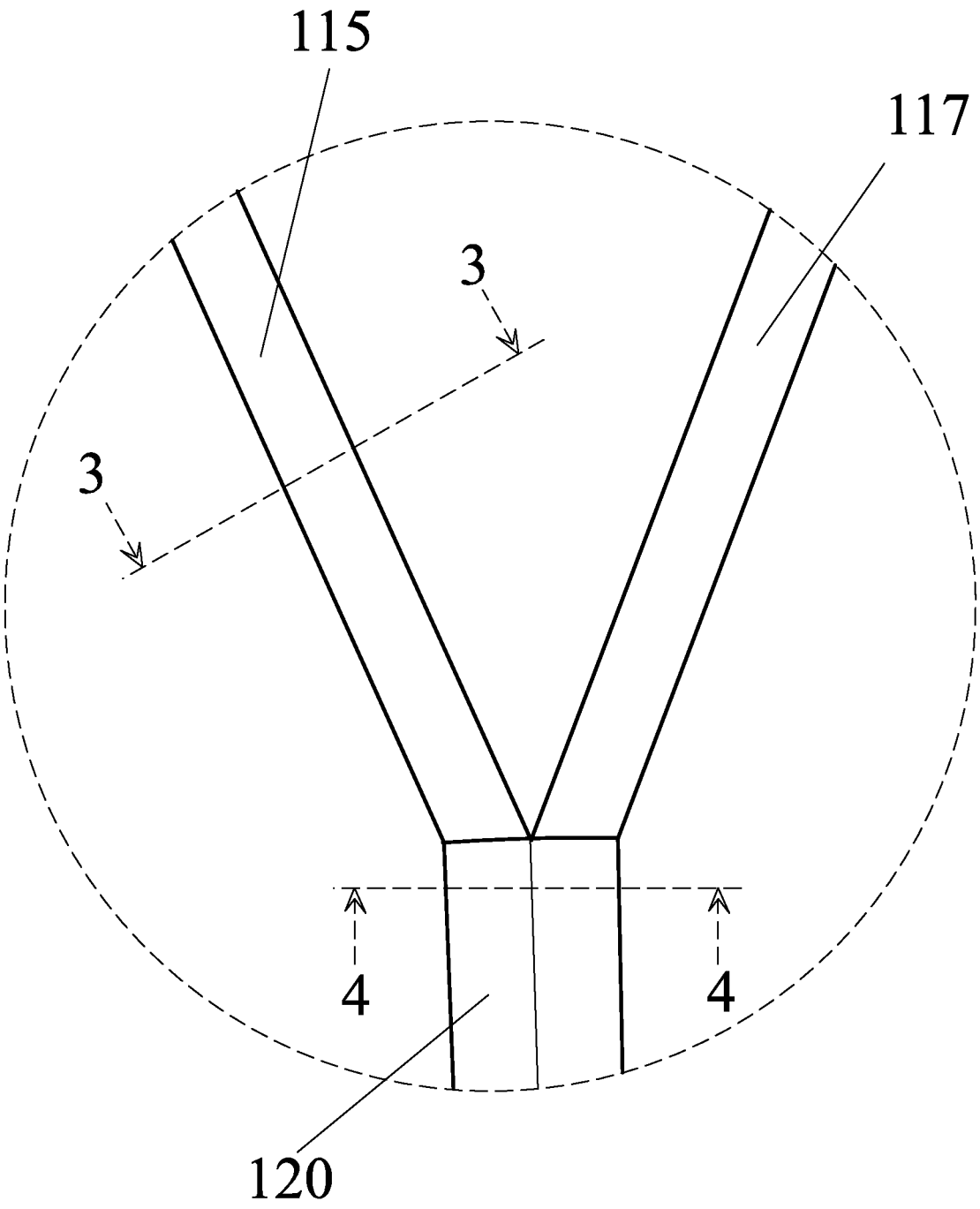
FIG. 2 is a close-up view of the portion shown in FIG. 1.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1, 7, 9 and 12, a bamboo splitter 100 has an outer support ring 110. An inner ring blade 125 is centrally located and a plurality of base blades 120 project out from inner ring blade 125. In the embodiment shown, eight base blades 120 are shown and will produce eight bamboo slats 455. A pair of slat blades 115, 117 is located from base blade 120 to an inner diameter of outer support ring 110. The angle between oppositely disposed left slat blade 115 and right slat blade 117 is selected to produce a parallel cutting space (shown as area A) bounded by a left slat blade 115 and an adjacent right slat blade 117. This is essential to the production of bamboo slats 455 that are produced having a shape that is much more easily used in construction than is possible with traditional bamboo splitters. Bamboo splitter 100 is secured to a frame 465 that holds it in place during use. Frame 465 also includes the means (not shown) to force bamboo 450 through bamboo splitter 100. Mounting tabs 112 have mounting holes 114 that are used to attach bamboo splitter 100 to frame 465. Of course other methods of attaching bamboo splitter 100 to frame 465 may be used as is known in the art. Bamboo slats 455 are produced when bamboo 450 is forced through bamboo splitter 100. Bamboo scrap 460 is produced because left and right adjacent blade pairs (115 and 117) are arranged in parallel pairs which greatly increases the usability of bamboo slats 455 produced. A circular blade or other cutting or milling means (not shown) can cut and further shape bamboo slat 455 after splitting to produce uniform bamboo slats 455 with orthogonal edges. Bamboo 450 is forced through bamboo splitter 100 using a hydraulic ram (not shown), but other methods of feeding bamboo 450 may be used as long as bamboo 450 is forced through bamboo splitter 100.

Although in the embodiment shown, steel is used to produce outer support ring 110, inner ring blade 125, base blades and slat blades 115 and 117, it is understood that any suitable material may be used such as, but not limited to aluminum, carbon fiber composites or other suitable material as long as structure is strong and blades maintain their edge. Also, it is within the purview of this disclosure that one or more of the blades could be replaceable or removable to sharpen without departing from the spirit of the instant invention.

Figure 3:
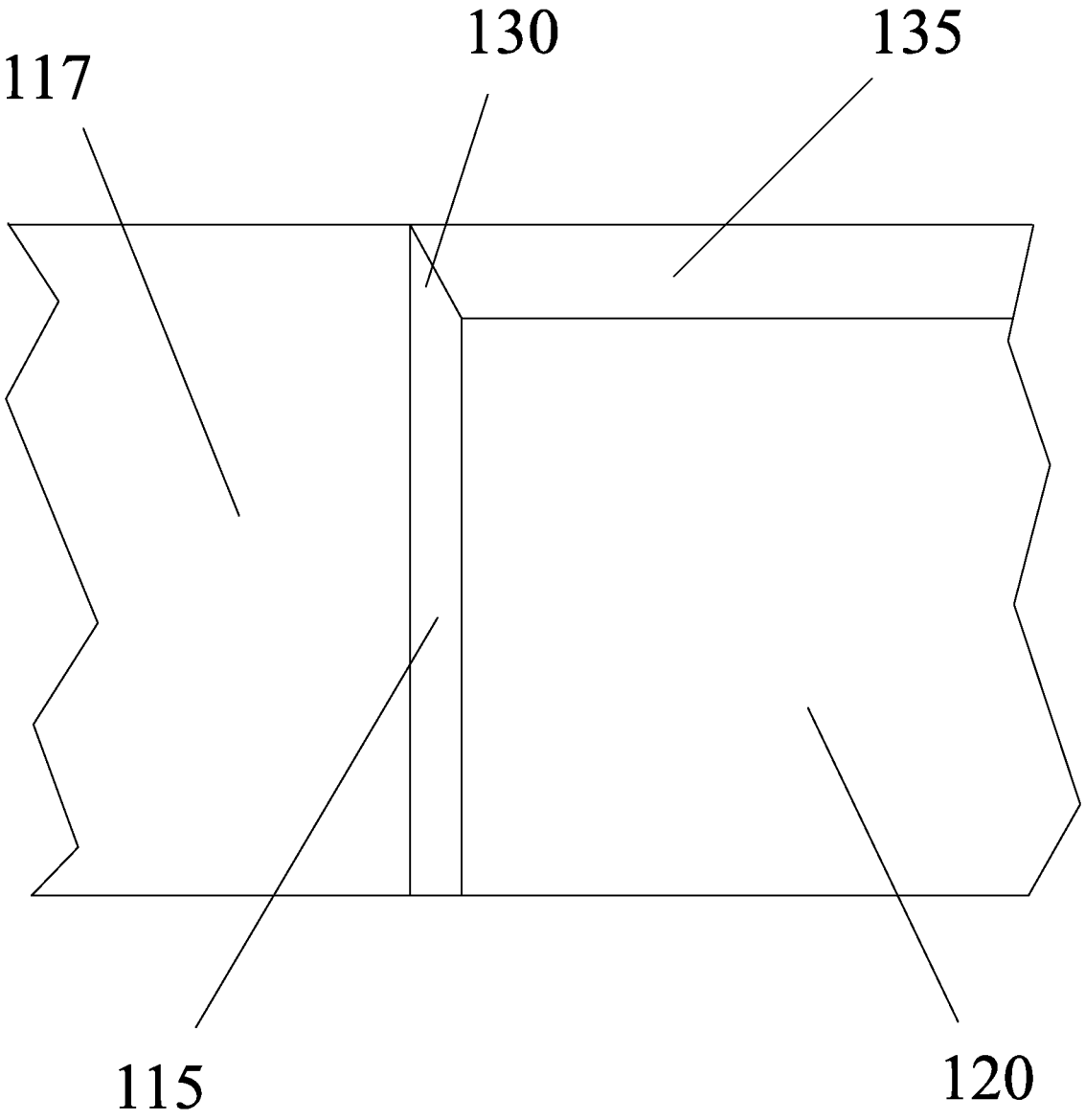
FIG. 3 is a sectional view along line 3-3 of FIG. 2.
Figure 4:
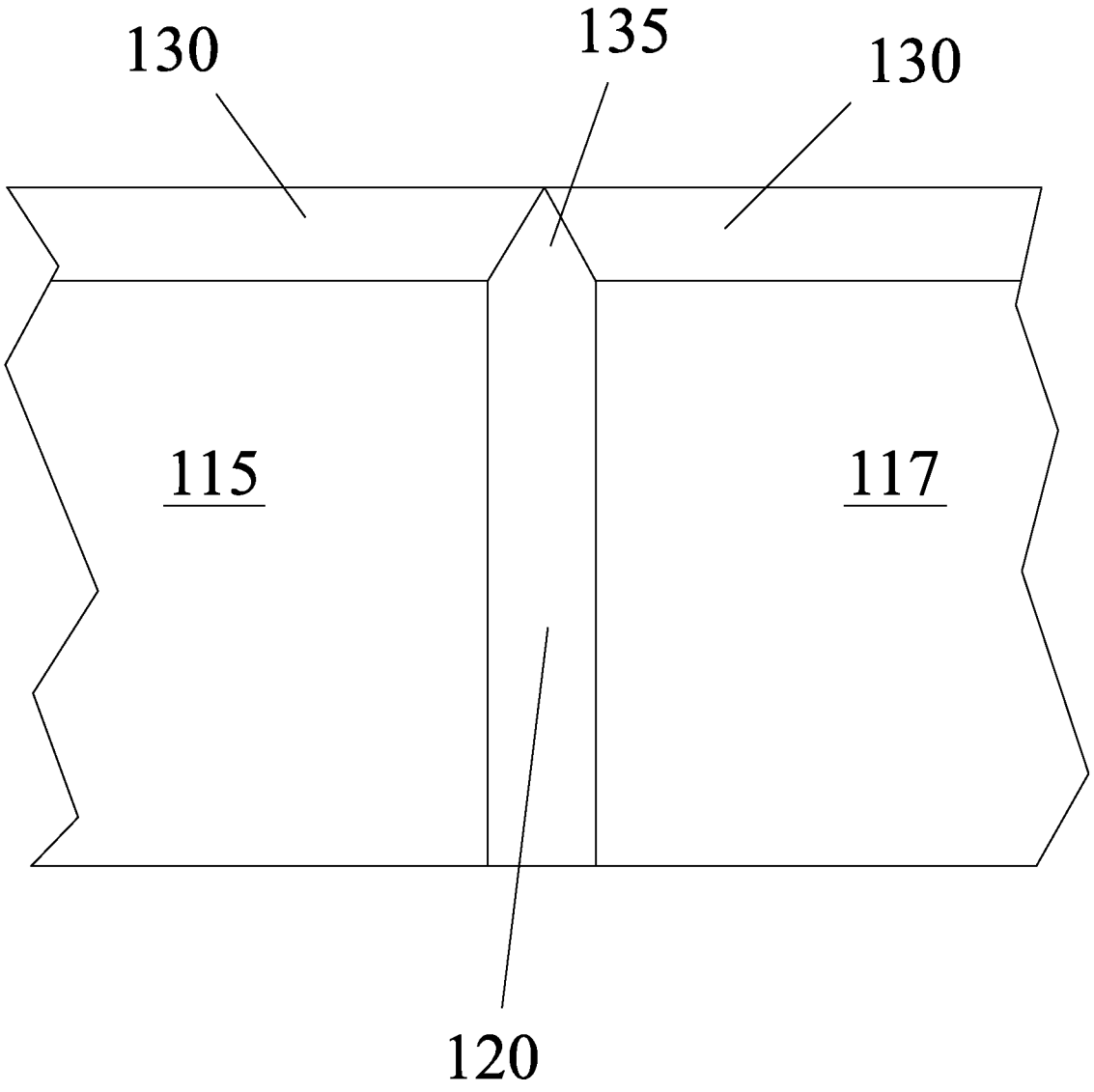
FIG. 4 is a sectional view along line 4-4 of FIG. 2.

Referring now to FIGS. 1-4, a detailed close-up view of base blade 120 and slat blades 115, 117 is shown with the blade profiles shown in FIGS. 3 and 4. FIG. 3 shows the blade profile of left slat blade 115 having a chisel edge portion 130. Chisel edge portion 130 has a vertical side and an angled side. The vertical side faces towards an oppositely disposed right slat blade 117 (as shown by area A) which produces a slat having flat orthogonal sides after splitting. The angled side is on a bamboo scrap side which enhances the value and usability of the slats produced.

FIG. 4 shows the profile of base blade 120. Base blade 120 has a v-edge portion 135 that splits evenly on both sides. The angle of v-edge portion 135 is not critical.

Figure 5:
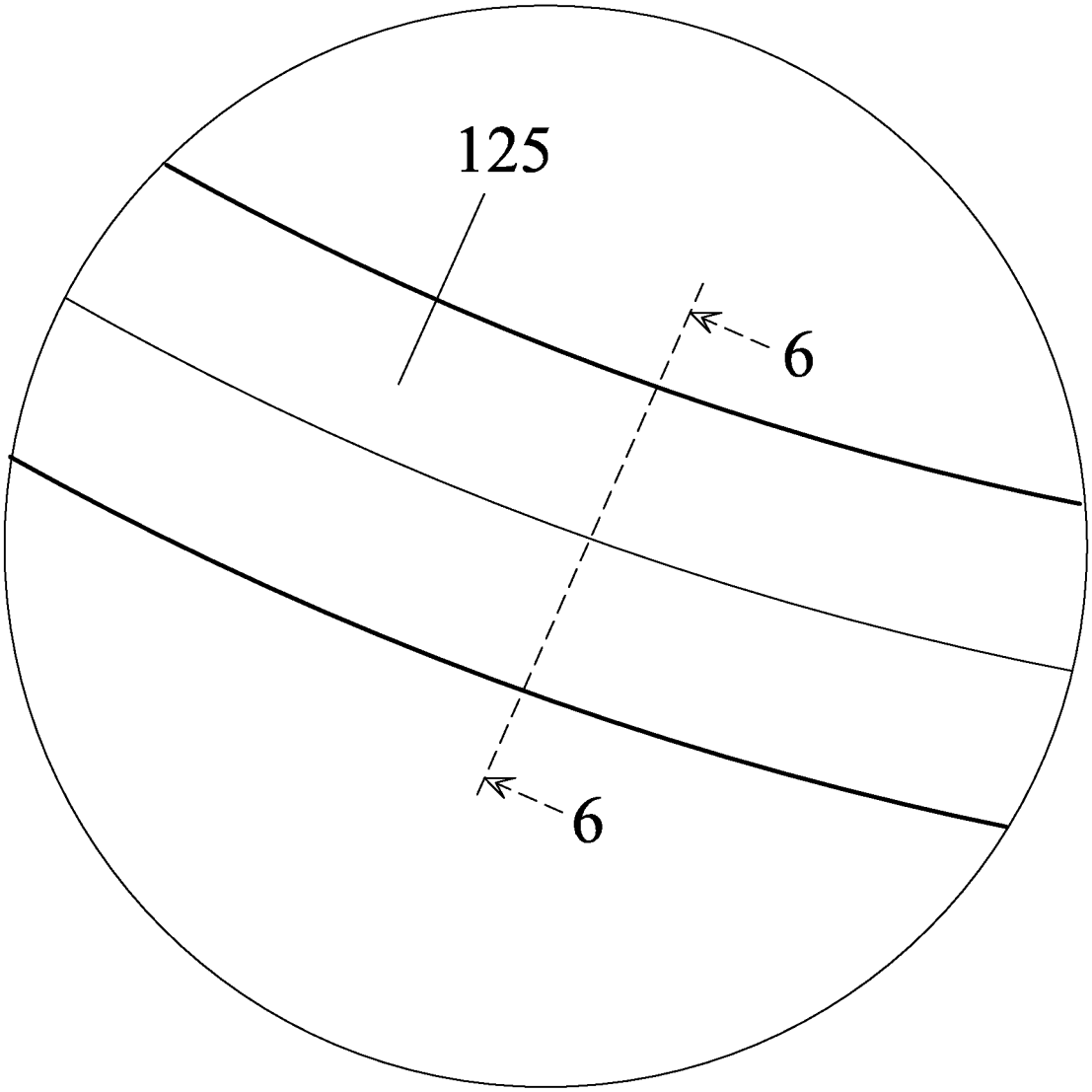
FIG. 5 is a close-up view of the portion shown in FIG. 1.
Figure 6:
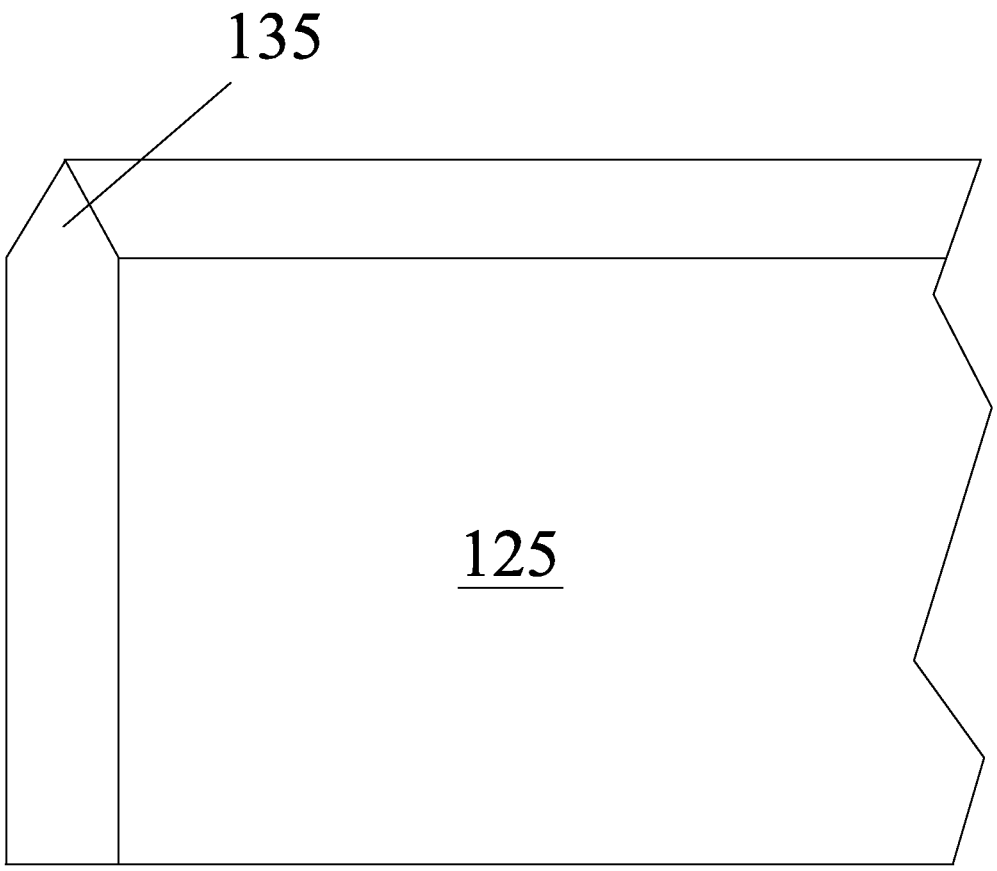
FIG. 6 is a sectional view along line 6-6 of FIG. 5.
Figure 7:
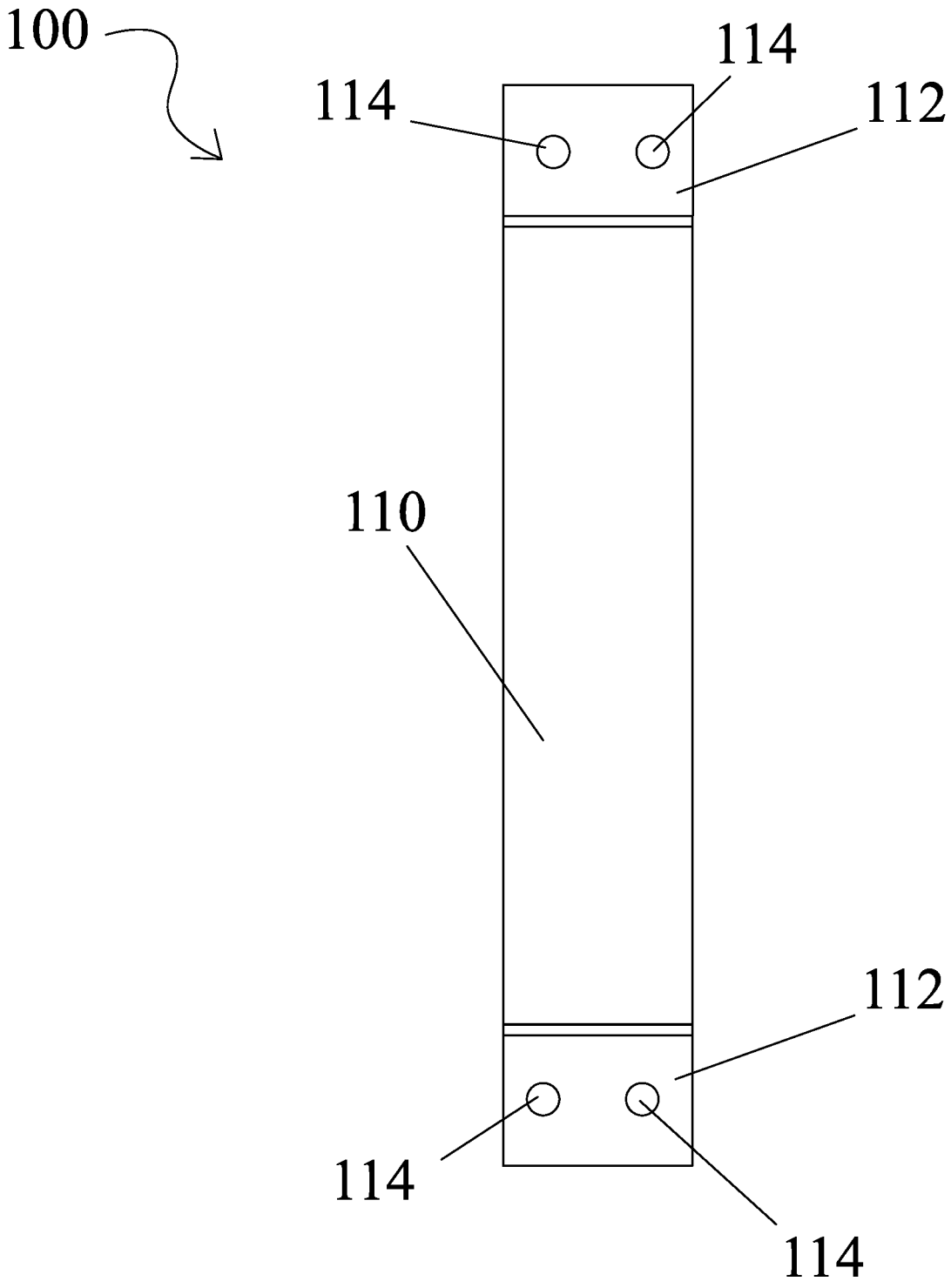
FIG. 7 is a side view of the bamboo splitter shown in FIG. 1.
Figure 9:
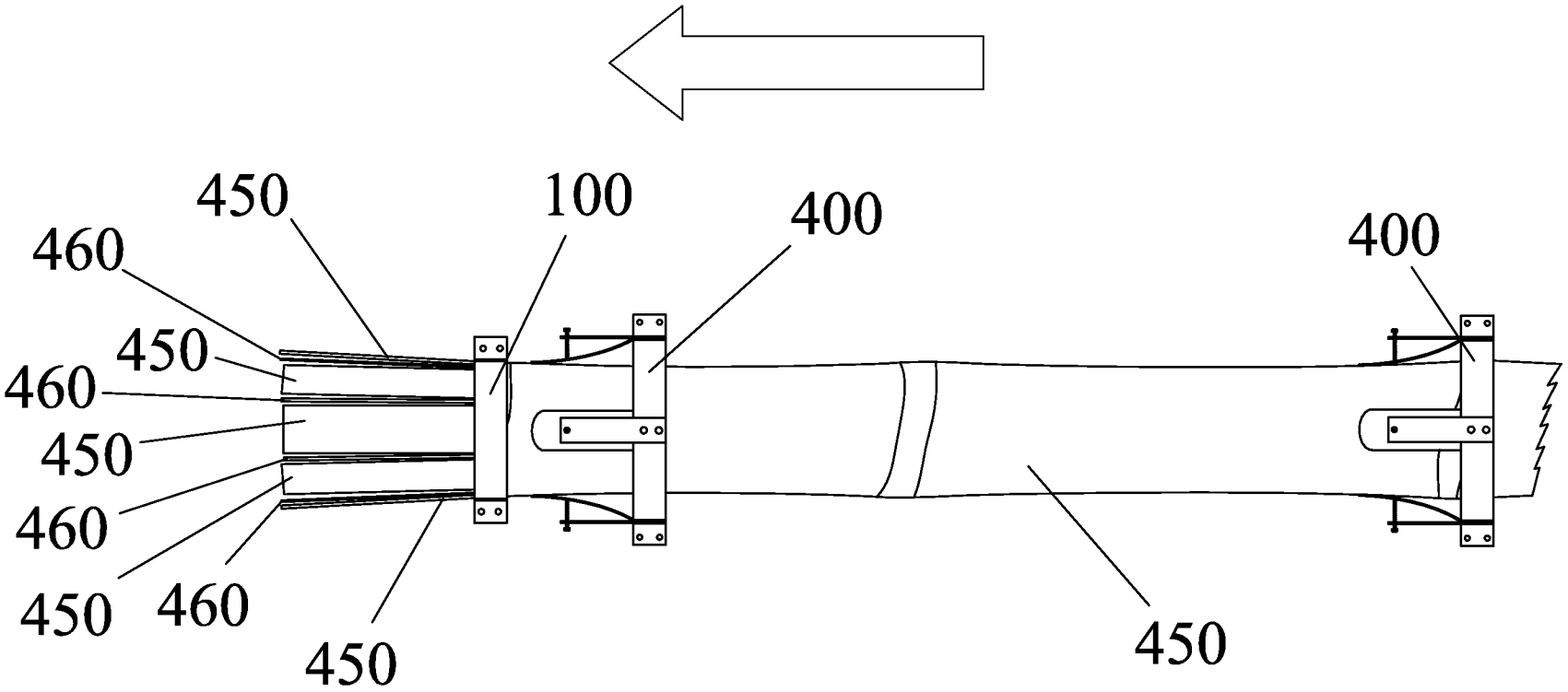
FIG. 9 is a side view of a typical bamboo splitting assembly setup utilizing splitter and guides according to the invention.

Now referring to FIGS. 5, 6 and 9, a close-up view of the section shown in FIG. 1 shows the details of inner ring blade 125. As with base blade 120, inner ring blade has a v-edge blade portion 135.

Figure 8:
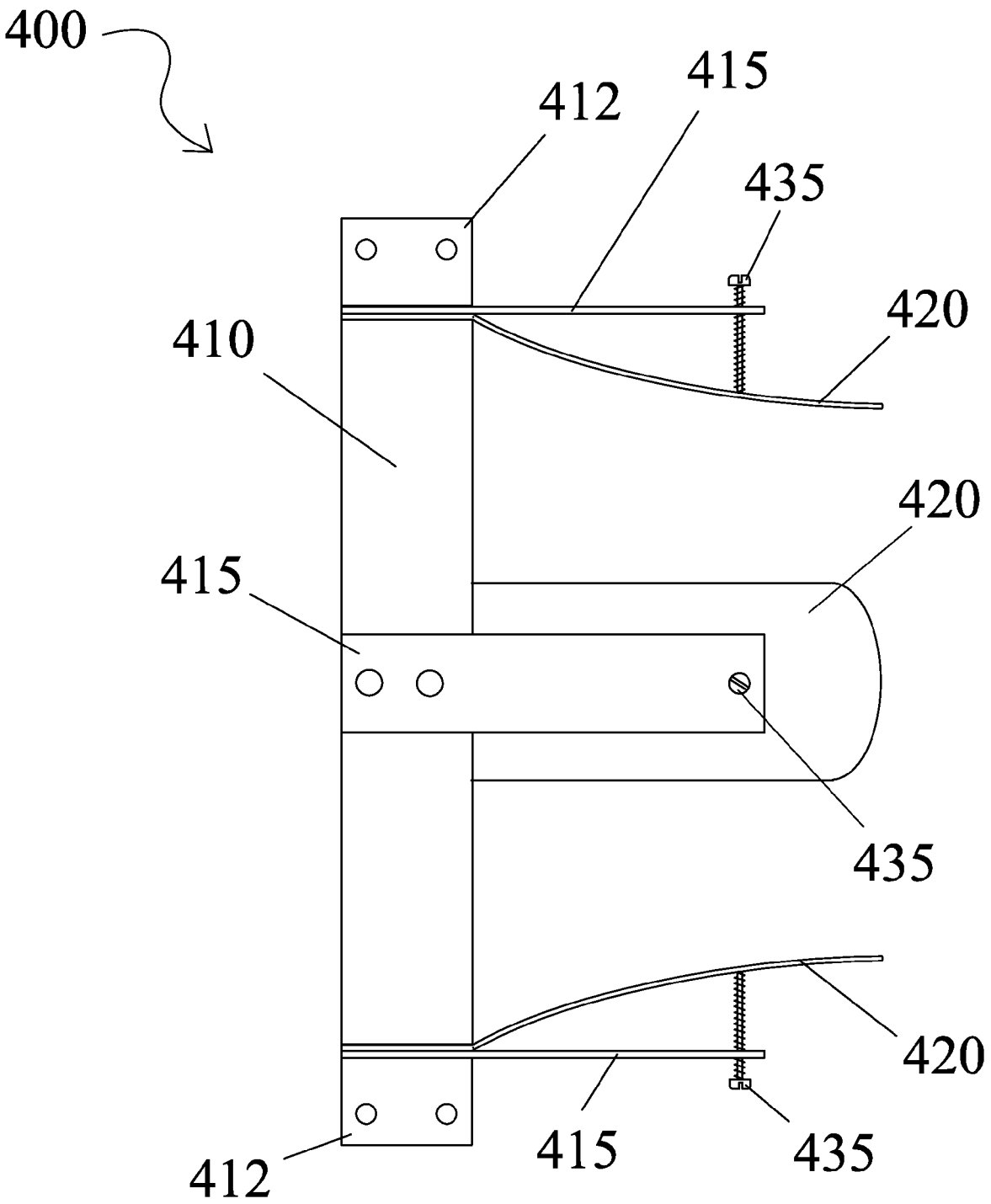
FIG. 8 is a side view of a bamboo splitter guide ring according to an embodiment of the invention.

Referring now to FIGS. 8 and 9, a guide assembly 400 is shown having a guide frame ring 410. Guide frame ring 410 has mounting tabs 412 that are used to attach guide frame ring 410 to the frame as discussed above (not shown). A plurality of rigid tongues 415 support spring fingers 420 which align and push against bamboo 450 as bamboo 450 is forced through bamboo splitter 100. As shown in FIG. 9, more than one guide assembly may be used to meet specific needs and may depend on the length of the bamboo being used. In general, the longer the bamboo, the more guide assemblies are used. The position and tension that spring fingers 420 apply on bamboo 450 is adjusted using an adjustment screw 435. Adjustment screw 435 is turned to move spring finger 420 to the selected position.

Figure 10:
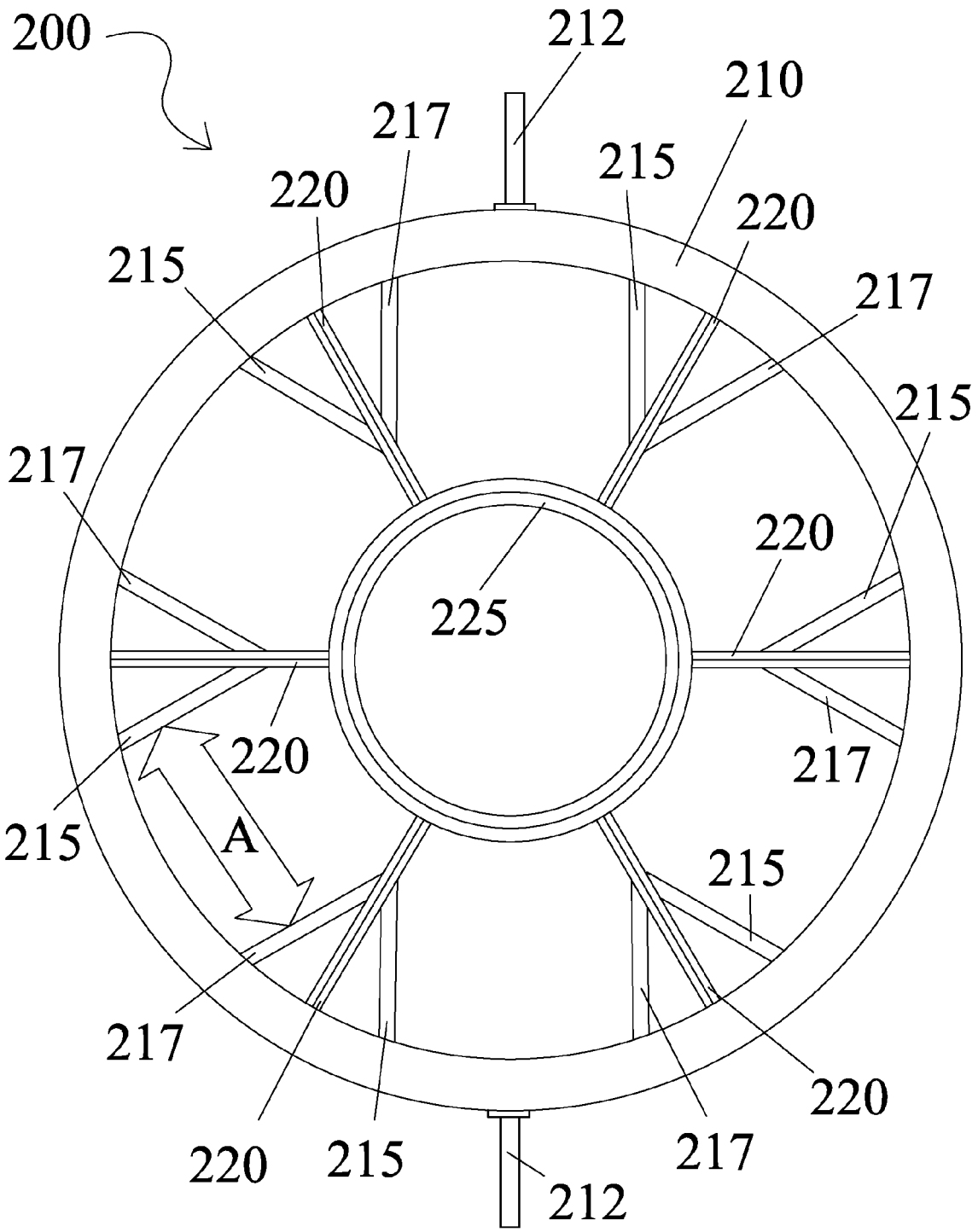
FIG. 10 is a front view of a bamboo splitter according to an embodiment of the invention.

Now referring to FIG. 10, a bamboo splitter 200 is shown having six base blades 220 disposed between an outer support ring 210 and an inner ring blade 225. Again, as discussed above, a pair of slat blades 215, 217 angle away from each base blade and the angle is selected to orient an adjacent right slat blade 217 parallel to an adjacent left slat blade 215 to form parallel cutting space A as discussed above. Again, slat blades 215 and 217 have a chisel edge portion 130 with the vertical portion facing the inner parallel space A with the angled portion facing the scrap portion. Base blades and inner ring blade are v-shaped blades as discussed above. A pair of mounting tabs 212 are used to attach bamboo splitter 200 to the frame (not shown as discussed above).

Figure 11:
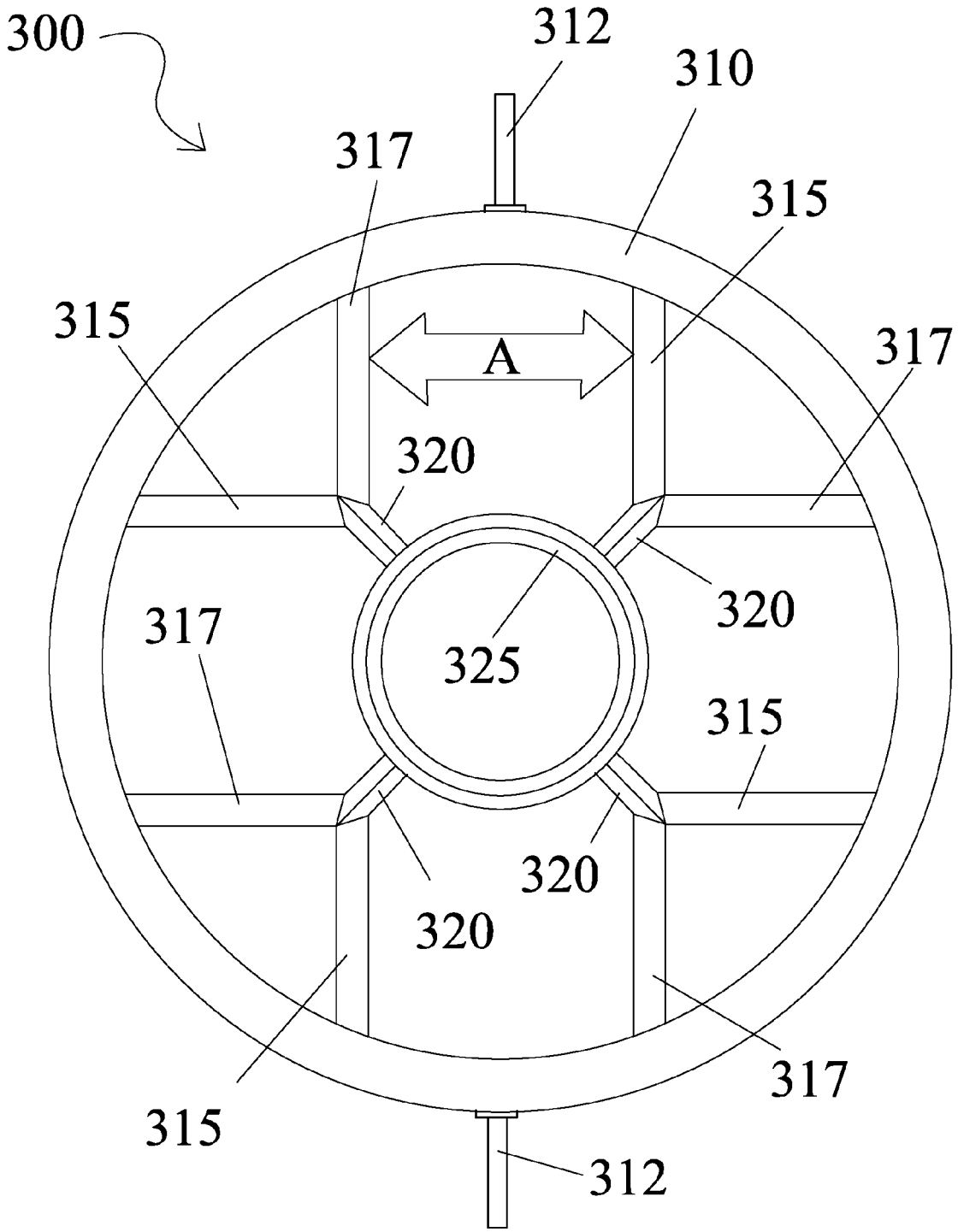
FIG. 11 is a front view of a bamboo splitter according to an embodiment of the invention

Now referring to FIG. 11, a bamboo splitter 300 is shown having four base blades 320 disposed between an outer support ring 310 and an inner ring blade 325. Again, as discussed above, a pair of slat blades 315, 317 angle away from each base blade and the angle is selected to orient an adjacent right slat blade 317 parallel to an adjacent left slat blade 315 to form parallel cutting space A as discussed above. Again, slat blades 315 and 317 have chisel edge portion 130 with the vertical portion facing inner parallel cutting space A with the angled portion facing the scrap portion. Base blades and inner ring blade are v-shaped blades as discussed above. A pair of mounting tabs 312 are used to attach bamboo splitter 30 to the frame (not shown as discussed above). The number of slat blades can vary and is chosen to match the size of the bamboo being slit and the size of the slat desired. Although we show embodiments for 8, 6 and 4 (FIGS. 1, 10 and 11 respectively) it is clear that any number of blades may be used depending on the size of the bamboo being processed and the size of the slats desired.

Figure 12:
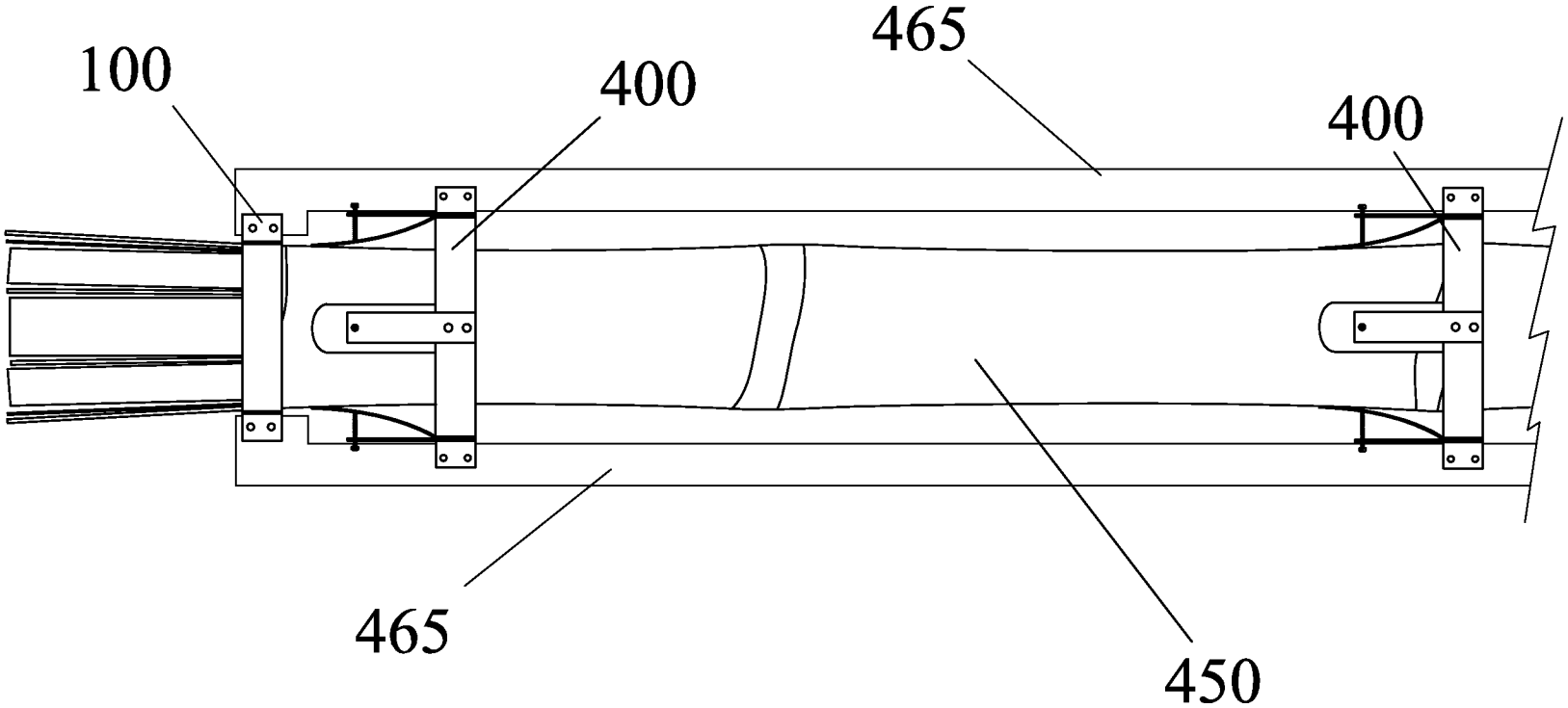
FIG. 12 is a side view of a typical bamboo splitting assembly setup mounted in a frame according to the invention.

Now referring to FIG. 12, bamboo splitter 100 and two guide assemblies 400 are mounted on a frame 465 to hold bamboo splitter 100 and guide assemblies 400 in place during use. Frame 465 may be made of steel or any other suitable material as long as bamboo splitter 100 is securely held in place during use. Of course frame 465 may have multiple attachment points as is known in the art.

Although the instant invention has been described in relation to particular embodiments thereof, many other variations and modifications and other uses will become apparent to those skilled in the art.

What is claimed is:

1. A bamboo splitter mounted in a frame comprising:
- an annular outer support ring;
- an annular inner ring blade disposed interior to said annular outer support ring and having a diameter smaller than said annular outer support ring;
- said annular inner ring blade having an inner ring v-edge cutting surface facing a plane perpendicular to said annular inner ring blade height;
- a plurality of radially disposed base blades arranged around said annular inner ring blade;
- each of said plurality of radially disposed base blades having an base blade inner edge attached to an outer diameter of said inner ring blade and an base blade outer edge extending outward towards said outer support ring;
- said plurality of base blades having a base blade v-edge cutting surface facing said plane;
- a plurality of slat blade pairs having a common vertex and a left slat blade and a right slat blade;
- each slat blade pair attached to each of said base blade outer edge;
- each said left slat blade and right slat blade a slat blade chisel edge cutting surface facing said plane;
- wherein said inner ring v-edge cutting surface, base blade v-edge cutting surfaces and said slat blades chisel edge cutting surfaces all point in the same direction;
- each of said left slat blade and said right slat blade attached to an inside diameter of said outer support ring; and
- each slat pair having an angle between said left slat blade and said right slat blade selected to orient adjacent slat pair to be parallel to each other wherein an adjacent left slat blade is parallel to an adjacent right slat blade.

2. The bamboo splitter mounted in a frame according to claim 1 further comprising:
- at least one guide assembly mounted to said frame;
  - each of said at least one guide assembly comprising;
    - a annular guide frame ring;
    - a plurality of rigid tongues disposed on said annular guide frame ring;
    - each one of said rigid tongues having a spring finger mounted towards an inwardly facing portion of said annular guide frame ring; an adjustment screw moveably disposed in said rigid tongue to adjust said spring finger wherein said spring fingers are adapted to guide a bamboo stock therein.

3. The bamboo splitter mounted in a frame according to claim 1 wherein said base blade outer edge is attached to said inner diameter of said outer support ring.

* * * * *